United States Patent [19]

Zeder

[11] Patent Number: 4,658,242

[45] Date of Patent: Apr. 14, 1987

[54] IMPEDANCE SENSING ANTI-THEFT DEVICE

[76] Inventor: Abraham Zeder, Stajer Corporation, 134 Middle St., Suite 320, Lowell, Mass. 01853

[21] Appl. No.: 742,558

[22] Filed: Jun. 7, 1985

[51] Int. Cl.[4] ..... G08B 13/22; G08B 13/14

[52] U.S. Cl. ..... 340/568; 340/572; 340/693

[58] Field of Search ..... 340/568, 572, 693

[56] References Cited

U.S. PATENT DOCUMENTS

| | | | |
|---|---|---|---|
| 3,230,519 | 1/1966 | Metz et al. | 340/568 |
| 3,544,984 | 12/1970 | Hanson | 340/572 |
| 3,553,674 | 1/1971 | Head | 340/572 |
| 4,028,691 | 6/1977 | Zeder | 340/568 |
| 4,293,852 | 10/1981 | Rogers | 340/568 |
| 4,319,228 | 3/1982 | Daniels | 340/693 |

*Primary Examiner*—Glen R. Swann, III

*Attorney, Agent, or Firm*—Jerry Cohen

[57] ABSTRACT

Theft of electrical appliances and the like is deterred by an alarm (40) which is activated when the appliance is disconnected from an impedance sensing alarm apparatus (10). A signal of a first magnitude is presented at an input of a detector (26) when the appliance is connected to the alarm apparatus. A signal of a second magnitude is presented at the input of the detector (26) when the appliance is disconnected from the alarm apparatus. The different magnitude of the signals is sensed by the detector (26) which, in turn, generates a control signal that activates an audible alarm (40) or the like.

2 Claims, 2 Drawing Figures

IMPEDANCE SENSING ANTI-THEFT DEVICE

BACKGROUND OF THE INVENTION

Field of the Invention

The present invention relates to anti-theft devices and, more particularly, is directed toward an impedance sensing alarm apparatus for electrical appliances.

Description of the Prior Art

Theft deterring apparatus of various types have been designed for electrical appliances. U.S. Pat. No. 4,028,691 discloses a theft deterring apparatus for electrical appliances with permanently attached power cords. The theft deterring apparatus has an audible alarm which is activated by unplugging the appliance or cutting the power cord. Such anti-theft devices have been met with varying degrees of success in that they are not adapted to operate with electrical appliances having removable power cords.

SUMMARY OF THE INVENTION

It is an object of the present invention to provide an apparatus for deterring theft of an electrical appliance.

It is a further object of the present invention to provide an impedance sensing apparatus for detecting unauthorized removal of one or more electrical appliances and for generating an alarm signal in response thereto. The impedance sensing apparatus includes a detector circuit which changes state as a function of the magnitude of a signal presented at its input. A divider network, which is configured to connect with the electrical appliance, controls the magnitude of the signal applied to the detector circuit. The impedance of the electrical appliance constitutes one leg of the divider network. Accordingly, removal of the electrical appliance changes the impedance of the divider network and the magnitude of the signal at the output of the divider network. A change in the magnitude of the signal at the output of the divider network produces a change in the signal at the output of the detector circuit and activates an alarm to signal unauthorized removal of the electric appliance.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent under consideration of the following detailed description taken in connection with the accompanying drawings, wherein.

DETAILED-DESCRIPTION OF THE-PREFERRED EMBODIMENT

Figure 1:
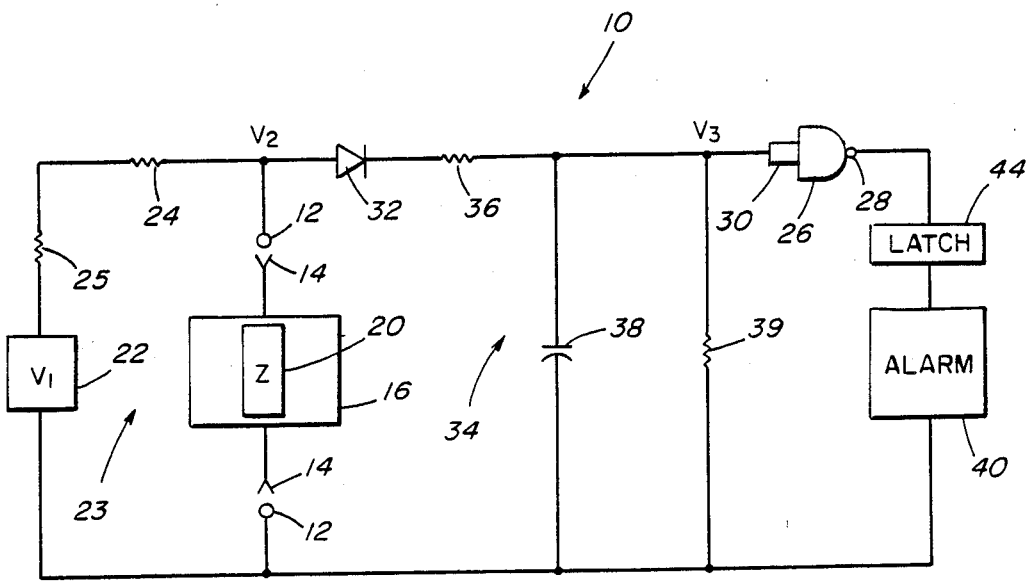
FIG. 1 is a simplified schematic diagram of an impedance sensing alarm apparatus embodying the invention.

Referring now to the drawings, particularly FIG. 1, there is shown a simplified schematic diagram of a theft deterring apparatus 10 embodying the invention. Theft deterring apparatus 10 is provided with a pair of connectors 12 which are configured to interconnect with jacks 14 of an electrical appliance 16. The electrical appliance 16 has an impedance 20 which is presented at jacks 14. A low voltage signal from a source 22 is applied through a resistor 25 to a voltage divider network 23 comprising impedance 20 and a resistor 24. The resistance of resistor 24 is greater than the impedance 20. Impedance 20 can be resistive, capacitive or inductive. The low voltage signal is a low voltage AC signal, for example a 12 volt, 60 hertz signal, which is used to sense the impedance 20 as hereinafter described.

The voltage $V_2$ at the junction of impedance 20 and resistor 24 is rectified by a diode 32 and filtered by a filter 34 comprising resistor 36 and capacitor 38. The filtered signal $V_3$ is applied to the input 30 of a detector 26, for example, a high impedance detector whose output signal varies as a function of the signal at its input. In the illustrated embodiment, the signal at the output 28 of detector unit 26 is high when the signal at the input 30 is low, and the signal at the output 28 is low when the signal at the input 30 is high. The impedance of divider network 23 is such that the voltage $V_2$ is maintained lower than the turn-on voltage of detector 26. A resistor 39 maintains the voltage $V_3$ at the input 30 of detector 26 low.

If electrical appliance 16 is removed, the voltage $V_2$ rises and the voltage $V_3$ at input 30 of detector unit 26 increases above the turn-on voltage of detector unit 26. In consequence, detector unit 26 changes state and the signal at output 28 goes low. When the input to a latching circuit 44 goes low, the output of the latching circuit goes high. An alarm 40 is activated when the signal at the output of the latching circuit 44 is high. The details of the theft deterring apparatus circuitry is shown in FIG. 2.

Figure 2:
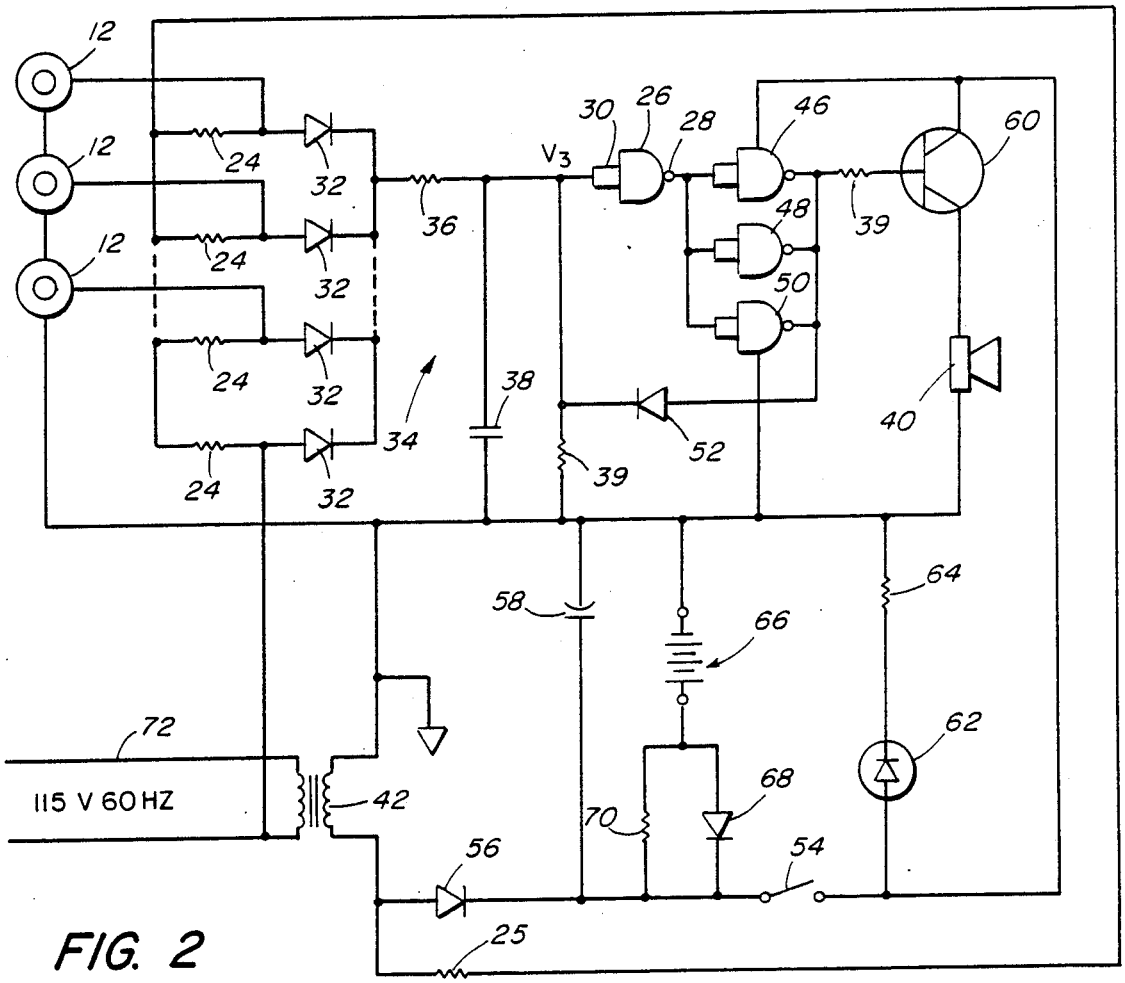
FIG. 2 is a detailed schematic diagram of the impedance sensing alarm apparatus of FIG. 1.

As shown in FIG. 2, connection between the theft deterring apparatus and one or more electrical appliances is made through a series of connectors 12, for example, jacks. The low voltage AC signal is provided from a step down transformer 42. Resistors 24 and diodes 32 are connected in an OR configuration with the impedance of the electric appliances to form a plurality of voltage divider circuits which produce the voltage $V_2$. Diodes 32 rectify the AC voltage passing through resistors 24. The rectified voltage is filtered in filter 34, which includes resistor 36 and capacitor 38, and applied to input 30 of detector unit 26.

As previously described, the voltage $V_3$ increases when the impedance 20 is removed from the voltage divider circuit 23, i.e. the electrical appliance is disconnected from jacks 12. When $V_3$ goes high, output 28 of detector unit 26 goes low. The output of latching circuit 44, which is comprised of NAND gates 46, 48 and 50, goes high when the output 28 of detector unit 26 goes low. The high output of latching circuit 44 causes a diode 52 to conduct which results in a high signal presented at the input 30 of detector unit 26. In consequence, the output 28 of detector unit 26 remains low and the output of latching circuit 44 is held high. A reset switch 54, which receives a rectified filtered signal via a diode 56 and a capacitor 58, resets the latching circuit 44.

The high signal at the output of the latching circuit 44 is applied to the base of an NPN transistor 60. Transistor 60 conducts and alarm 40 is energized. An indicator 62, for example a light-emitting diode with a dropping resistor 64, is provided to indicate that theft deterring appliance is ON.

In the preferred embodiment, a rechargeable battery 66 is provided to supply power in case of a power failure or if the power cord 72 is either cut or removed. The rechargeable battery 66 is charged through resistor 70 during normal operation. During power failure, battery 66 supplies power to the circuit via a diode 68. Diode 68 and a resistor 70 are connected in parallel to the positive side of battery 66.

Typical components shown in FIGS. 1 and 2 are as follows:

battery 66—9 V DC
source 22—12 V AC
capacitor 38—0.22 microfarads
resistor 36—120K ohms
resistor 24—330K ohms
resistor 25—15 ohms
diode 32—1N4003
diode 52—1N4003
diode 56—1N4003
transistor 6—MSPA 14
alarm 40—piezo type
resistor 39—10M ohms
gate 26—part of NAND gate CD4011
gate 46—part of NAND gate CD4011
gate 48—part of NAND gate CD4011
gate 50—part of NAND gate CD4011
capacitor 58—1000 microfarads
resistor 64—1K ohms
resistor 70—1K ohms Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. An impedance sensing apparatus for deterring theft of electrical appliances, said apparatus comprising:

(a) common voltage source means;

(b) an array of multiple voltage divider means connected to said common voltage source means, each of said voltage divider means including input means and output means, said input means of each divider, configured to be interconnected with an electrical applicance and comprising jack means for inserting the input impedance of said appliance into a leg of the divider circuit, a first low voltage a.c. signal being presented at said output means of each divider when an electrical applicance is connected to said input means and a second low voltage a.c. signal being presented at said output means of each divider when the electrical appliance is disconnected from said input means of the divider and comprising an array of means for rectifying and filtering the low voltage a.c. signals to d.c.; each said voltage divider having in one leg a resistive impedence and in the other leg said applicance's input impedance, the resistive impedance being selected to be greater than the expected range of input impedances;

(c) high impedance detector means having input means and output means, said detector input means being operatively connected in common to said array of voltage divider means output means, said detector means having first and second states, said detector means being in said first state when all of the electrical applicances of the array are connected and in said second state when one of the electrical applicances is disconnected, a first control signal being presented at said output means of said detector means when said detector means is in said first state and a second control signal being presented at said output means of said detector means when said detector means is in said second state; and (d) alarm means operatively connected to said output means of said detector means for generating an alarm when said detector means is in said second state, and further including latching means connected to said output means of said detector means comprising NAND gates, said latching means operative to maintain said detector means in said second state.

2. The impedance sensing apparatus as claimed in claim 1 including a rechargeable power source for providing power to said voltage divider means in the absence of power from said voltage source means.

* * * * *